US009623572B2

(12) United States Patent
Pai et al.

(10) Patent No.: US 9,623,572 B2
(45) Date of Patent: Apr. 18, 2017

(54) CUTTER ASSEMBLY HAVING A SCREW-LOCKING DEVICE

(71) Applicant: SDI Corporation, Chang Hua (TW)

(72) Inventors: Cheng-Yu Pai, Chang Hua (TW); Yao-Chia Chu, Chang Hua (TW); Ching-Li Chen, Chang Hua (TW); Chou-Chieh Tsai, Chang Hua (TW)

(73) Assignee: SDI Corporation, Chang Hua (TW)

( * ) Notice: Subject to any disclaimer, the term of this patent is extended or adjusted under 35 U.S.C. 154(b) by 144 days.

(21) Appl. No.: 14/495,985

(22) Filed: Sep. 25, 2014

(65) Prior Publication Data

US 2016/0089798 A1 Mar. 31, 2016

(51) Int. Cl.
*B26B 3/06* (2006.01)
*B26B 5/00* (2006.01)

(52) U.S. Cl.
CPC ..... *B26B 5/001* (2013.01)

(58) Field of Classification Search
CPC B26B 5/002; B26B 5/001; B26B 1/08; B26B 1/048
USPC ..... 30/162, 335, 342
See application file for complete search history.

(56) References Cited

U.S. PATENT DOCUMENTS

| | | | | |
|---|---|---|---|---|
| 2,870,537 | A | 1/1959 | Ortner | |
| 3,448,518 | A | 6/1969 | Sklar | |
| 3,518,758 | A | 7/1970 | Bennett | |
| 3,660,895 | A * | 5/1972 | West | B26B 5/005 30/162 |
| 3,857,176 | A * | 12/1974 | Quenot | B26B 5/001 30/162 |
| 4,200,977 | A | 5/1980 | Kageyama et al. | |
| 5,502,896 | A * | 4/1996 | Chen | B26B 5/002 30/162 |
| 6,745,474 | B1 * | 6/2004 | Huang | B26B 5/002 30/162 |
| 7,987,602 | B2 * | 8/2011 | Kanemoto | B26B 5/001 30/152 |
| 8,413,339 | B2 * | 4/2013 | Ranieri | B26B 5/002 30/162 |
| 2015/0013171 | A1 * | 1/2015 | Wu | B26B 5/003 30/162 |

* cited by examiner

*Primary Examiner* — Omar Flores Sanchez
(74) *Attorney, Agent, or Firm* — Alan D. Kamrath; Kamrath IP Lawfirm, P.A.

(57) ABSTRACT

A cutter assembly has a blade holder, a blade, a slider and a screw-locking device. The blade is moveably mounted in the blade holder and has a moving direction. The blade holder has a bottom and multiple engaging segments disposed on the bottom along the moving direction of the blade. The slider is mounted slidably on the blade holder and connected to the blade. The screw-locking device is mounted on the slider and has a locking bolt and a locking sleeve screwed with each other. The locking bolt has an end selectively engaging at least one of the engaging segments.

18 Claims, 11 Drawing Sheets

CUTTER ASSEMBLY HAVING A SCREW-LOCKING DEVICE

BACKGROUND OF THE INVENTION

1. Field of the Invention

The present invention relates to a cutter assembly and, more particularly, to a cutter assembly having a screw-locking device.

2. Description of Related Art

A retractable cutter is applied to cut paper or wooden sheets and substantially comprises a blade holder, a blade and a slider. The slider is mounted on the blade holder. The blade is mounted slidably in the blade holder and is connected to the slider. When the slider is pushed, the blade is moved relative to the blade holder to extend out of the blade holder to enable a user to cut an object by the cutter. To hold the blade at a desired position with a desired extension length relative to the blade holder and to provide a large positioning force, a screw-locking device is mounted on the slider for cutting a thick or hard object. The conventional screw-locking device substantially comprises a threaded rod mounted on the slider. When the threaded rod is rotated to make the threaded rod abut against an inner surface of the blade holder, the slider can be positioned relative to the blade holder. When the threaded rod is released, the slider is moveable relative to the blade holder to adjust the extension length of the blade relative to the blade holder.

However, the locking force of the conventional screw-locking device is achieved by friction between the end of the threaded rod and the inner surface of the blade holder. Thus, the locking force of the conventional screw-locking device is not sufficient, and the slider and the blade are easily moved when a specific pushing or pulling force is applied to the cutter. Thus, the blade cannot be positioned firmly and stably. In addition, the threaded rod and the inner surface of the blade holder are easily worn off due to the abutment between the threaded rod and the inner surface of the blade holder, and depressions or scratches are easily formed on the inner surface of the blade holder. Accordingly, the conventional screw-locking device cannot provide a sufficient locking force to the blade.

To overcome the shortcomings, the present invention provides a cutter assembly to mitigate or obviate the aforementioned problems.

SUMMARY OF THE INVENTION

The main objective of the invention is to provide a cutter assembly having a screw-locking device to provide an excellent locking force.

The cutter assembly in accordance with the present invention has a blade holder, a blade, a slider and a screw-locking device. The blade is moveably mounted in the blade holder and has a moving direction. The blade holder has a bottom and multiple engaging segments disposed on the bottom along the moving direction of the blade. The slider is mounted slidably on the blade holder and connected to the blade. The screw-locking device is mounted rotatably on the slider and has a locking bolt and a locking sleeve screwed with each other. The locking bolt has an end selectively engaging at least one of the engaging segments.

With such an arrangement, a firm and stable locking force can be provided to the slider and the blade with the engagement between the engaging segments on the bottom of the blade holder and the locking bolt. The blade will not be moved unintentionally while a large force is applied to the blade. In addition, wear between the locking bolt and the blade holder can be prevented, a firm and stable locking force is provided to the blade, and the service life of the cutter assembly can be also prolonged.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
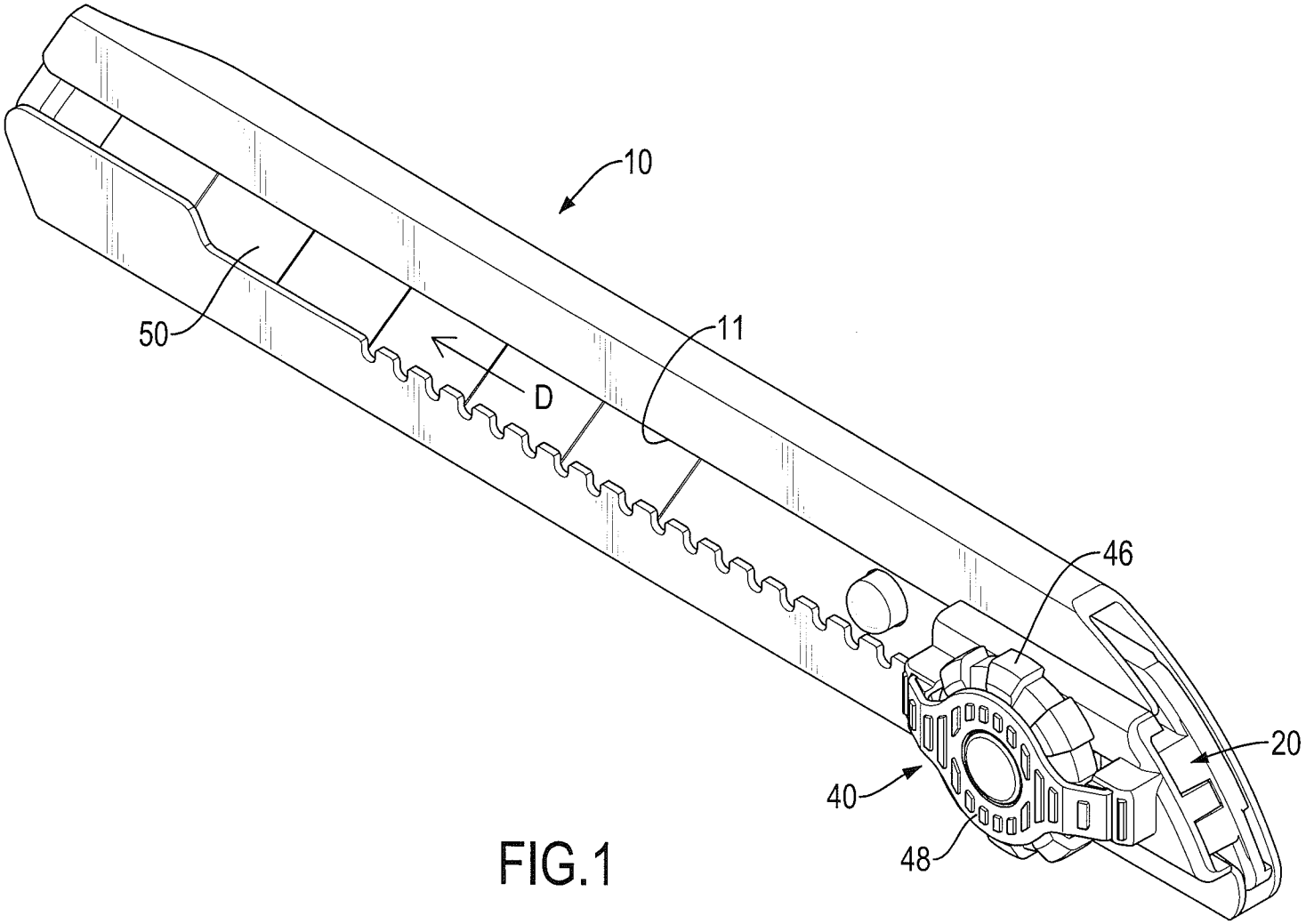
FIG. 1 is a perspective view of a first embodiment of a cutter assembly in accordance with the present invention.
Figure 2:
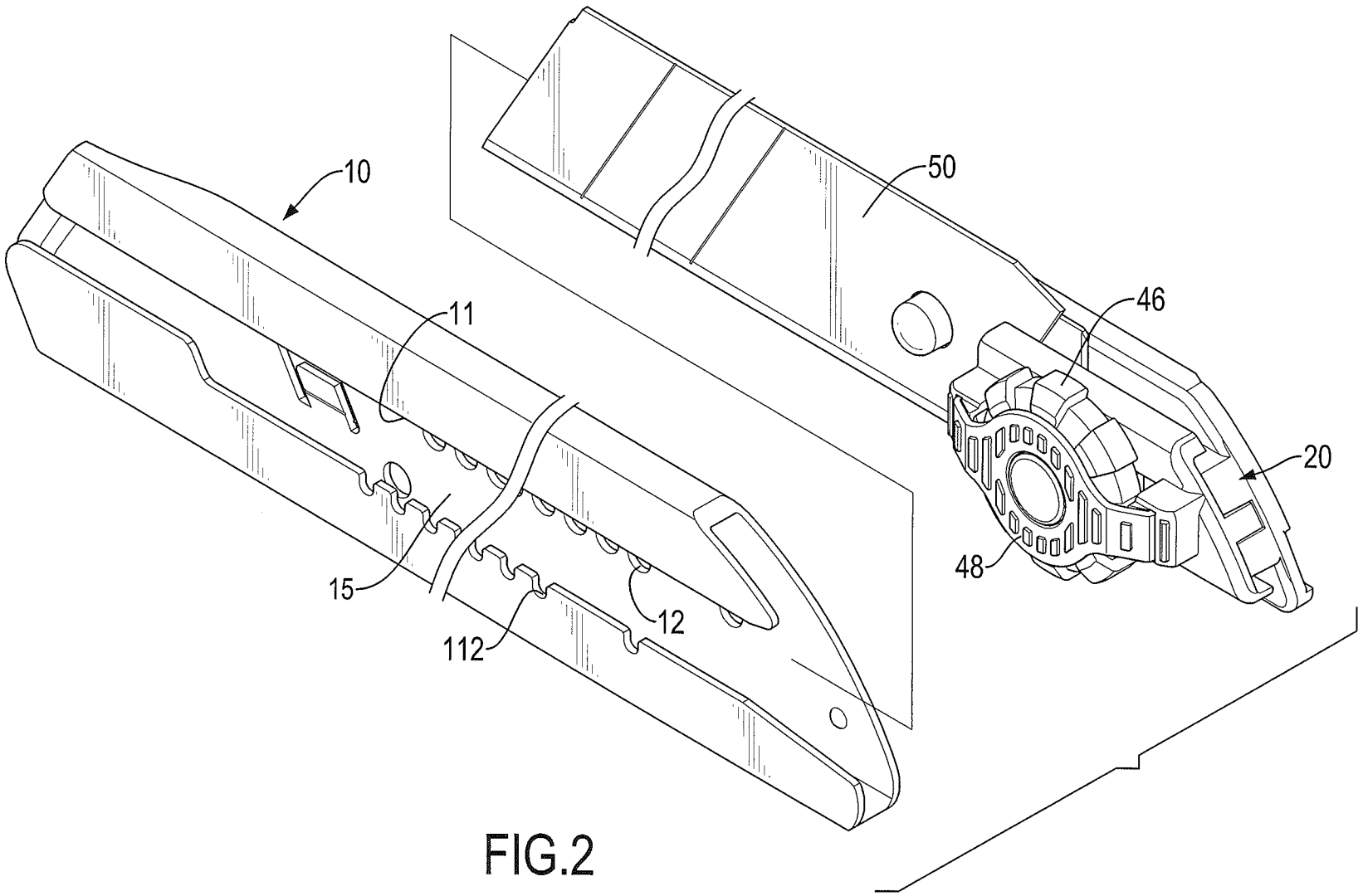
FIG. 2 is an exploded perspective view of the cutter assembly in FIG. 1.
Figure 3:
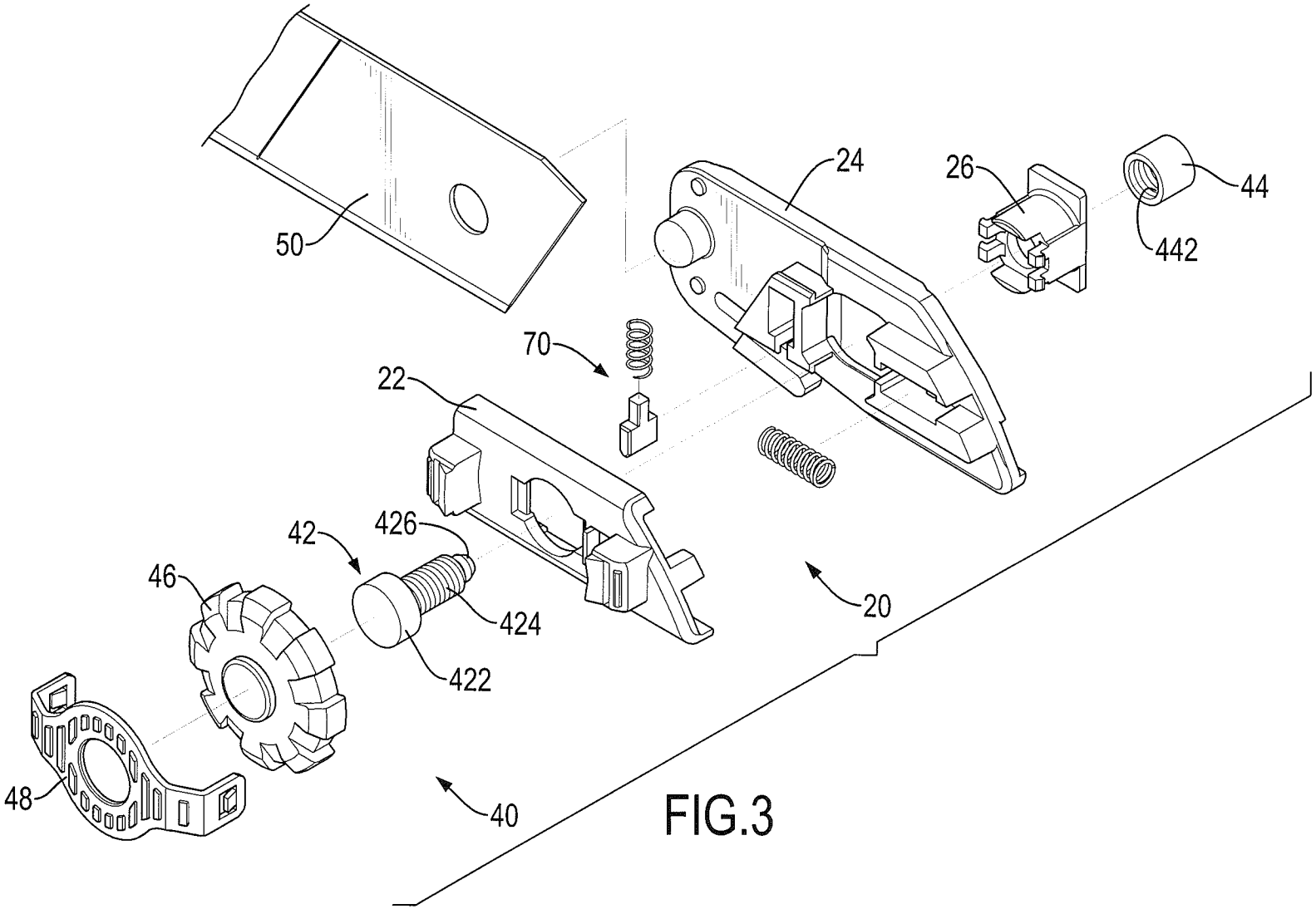
FIG. 3 is an enlarged exploded perspective view of a slider, a blade, a screw-locking device and a protective cap of the cutter assembly in FIG. 1.
Figure 4:
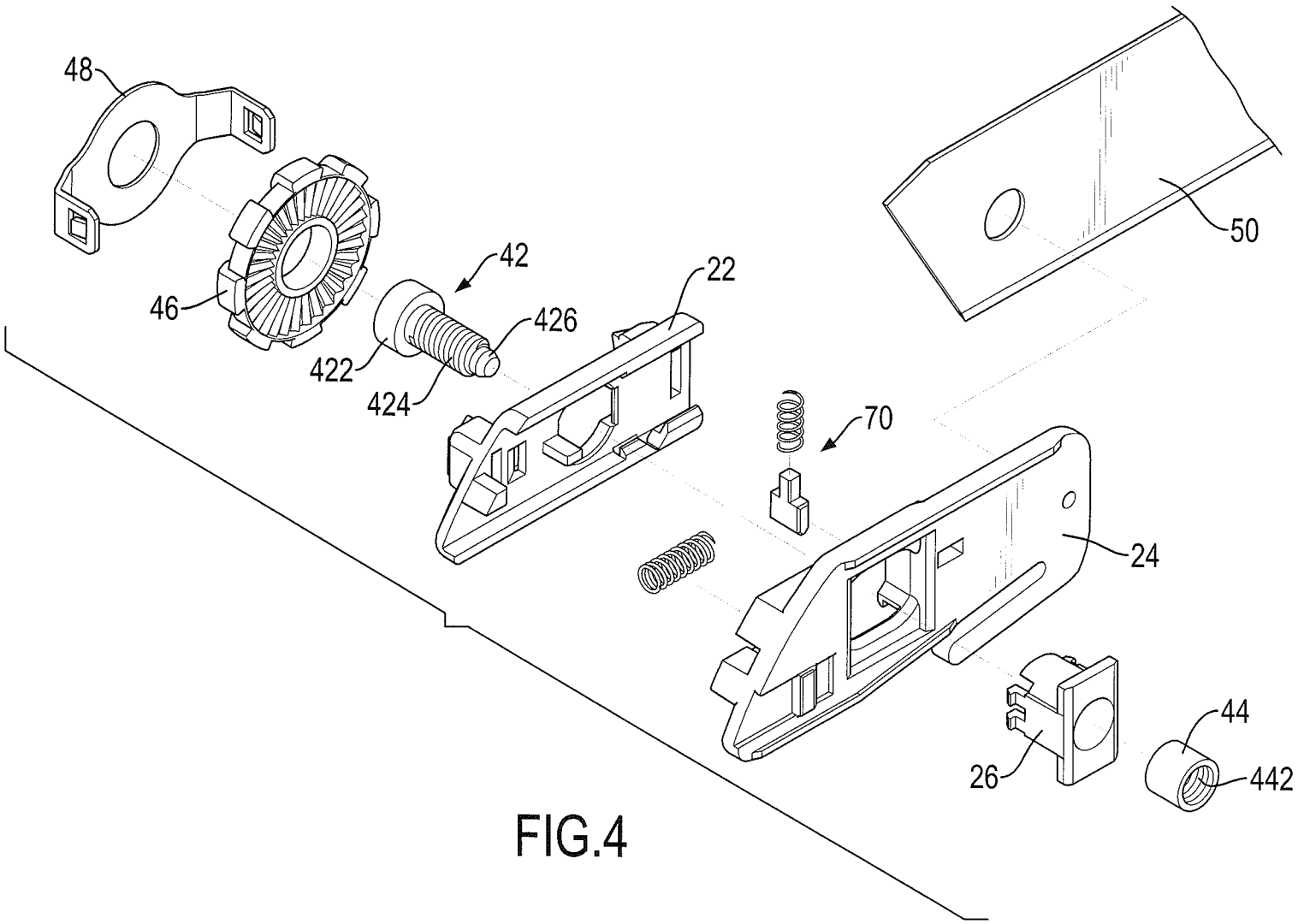
FIG. 4 is another exploded perspective view of the slider, the blade, the screw-locking device and the protective cap of the cutter assembly in FIG. 3.

With reference to FIGS. 1 to 4, a first embodiment of a cutter assembly in accordance with the present invention comprises a blade holder 10, a slider 20, an automatic locking device 70, a screw-locking device 40 and a blade 50. The blade 50 is moveably mounted in the blade holder 10.

The blade holder 10 comprises multiple engaging segments 12 disposed on a bottom 15 of the blade holder and arranged along a moving direction D of the blade 50. Preferably, the bottom 15 of the blade holder 10 has a flat inner surface. The engaging segments 12 are arranged in a line and may be holes, recesses or ribs arranged at intervals. The shapes of the engaging segments 12 may be round or square. In the first embodiment, the engaging segments 12 are engaging holes formed through the blade holder 10. A guiding channel 11 is defined in a side of the blade holder 10 and has two side edges. Multiple positioning segments 112 are formed in one of the two side edges of the guiding channel 11 and correspond respectively to the engaging segments 12 in position. The positioning segments 112 may be teeth. The slider 20 is mounted slidably on the blade holder 10 relative to the positioning segments 112 on the guiding channel 11 and comprises an upper sliding member 22 and a lower sliding member 24. The blade 50 is connected with the lower sliding member 24 of the slider 20, such that the blade 50 can be moved relative to the blade holder 10 with the slider 20. The automatic locking device 70 is mounted on the slider 20 and resiliently engages with the positioning segments 112 on the blade holder 10 to provide an automatic locking effect to the slider 20.

Figure 10:
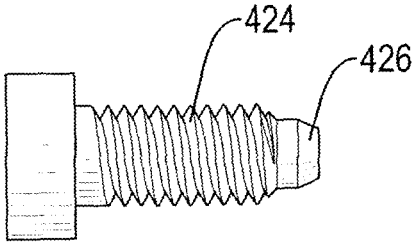
FIG. 10 is a perspective view of a first embodiment of a locking bolt of the cutter assembly in accordance with the present invention.
Figure 11:
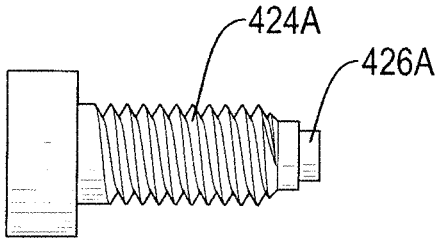
FIG. 11 is a perspective view of a second embodiment of a locking bolt of the cutter assembly in accordance with the present invention.

The screw-locking device 40 is mounted on the slider 20 and comprises a locking bolt 42 and a locking sleeve 44 screwed with each other. The locking bolt 42 is mounted rotatably on the upper sliding member 22 and comprises a head 422 and a threaded rod 424. The head 422 is formed on one end of the threaded rod 424. The threaded rod 424 extends through the slider 20 and selectively engages at least one of the engaging segments 12 on the blade holder 10. With reference to FIGS. 10 and 11, the end of the threaded rod 424,424A engaging the engaging segments 12 is defined as an engaging end and has a guiding structure 426,426A to make the end of the threaded rod 424,424A non-flat. The guiding structure 426,426A has an outer diameter smaller than an outer diameter of the threaded rod 424,424A, such that the engaging end of the threaded rod 424,424A can smoothly engage with the engaging segments 12. The guiding structure 426,426A may be a conical protrusion having a gradually decreasing diameter as shown in FIG. 10 or a protrusion having a diameter smaller than a diameter of the threaded rod 424A as shown in FIG. 11. In the embodiment shown in FIG. 11, the guiding structure 426A on the threaded rod is formed as a stepped shape and has a flat shoulder surface. Accordingly, when the engaging end of the threaded rod 424A engages with a corresponding one of the engaging segments 12, the shoulder surface will abut the blade holder 10. When the locking bolt 42 is rotated to extend the engaging end into the corresponding engaging segment 12 and make the shoulder surface abut the blade holder 10, the abutment between the shoulder surface and the bottom 15 of the blade holder 10 enhances the locking force between the locking bolt 42 and the blade holder 10. In addition, a rotating knob 46 is mounted around the head 422 to allow a user to turn the locking bolt 42 conveniently. The locking sleeve 44 is mounted in the lower sliding member 24 and has a threaded hole 442 screwed with the locking bolt 42. In addition, a sleeve mount 26 is mounted on the lower sliding member 24, and the locking sleeve 44 is securely mounted on the sleeve mount 26. Furthermore, a protective cap 48 is mounted on the upper sliding member 22 and covers the rotating knob 46 to prevent the locking bolt 42 from being rotated unintentionally.

Figure 5:
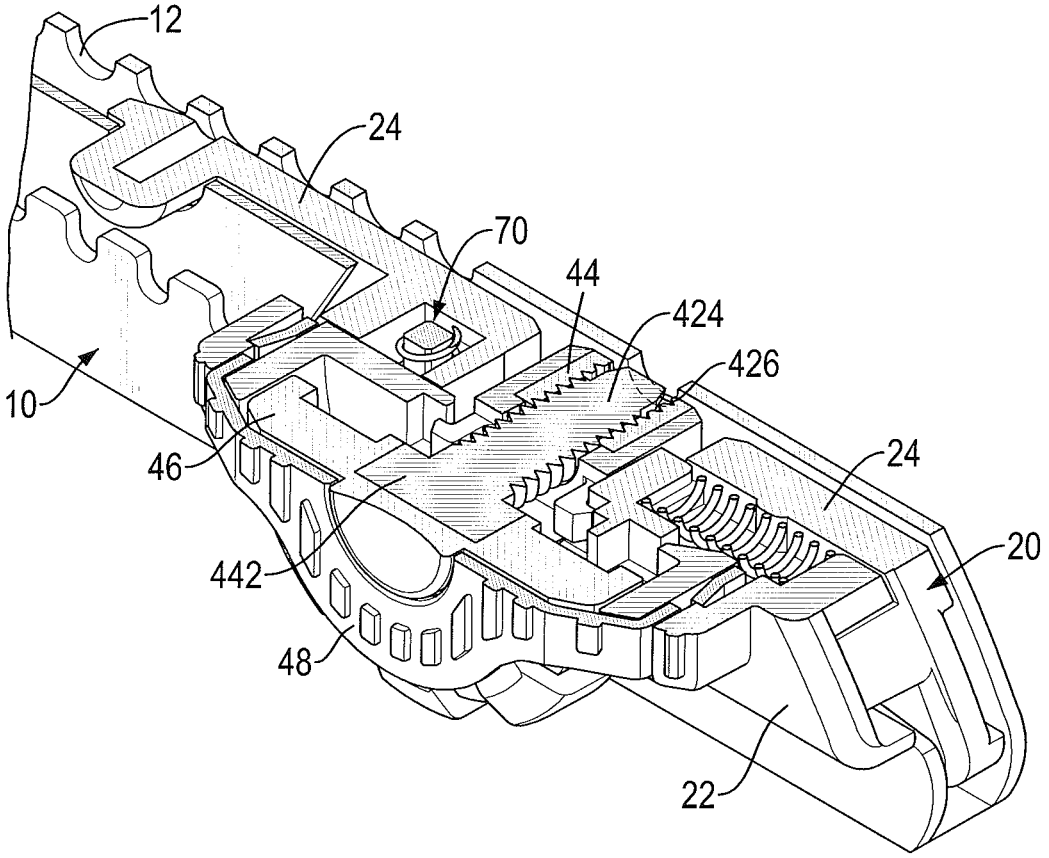
FIG. 5 is an enlarged cross sectional perspective view of the cutter assembly in FIG. 1.
Figure 6:
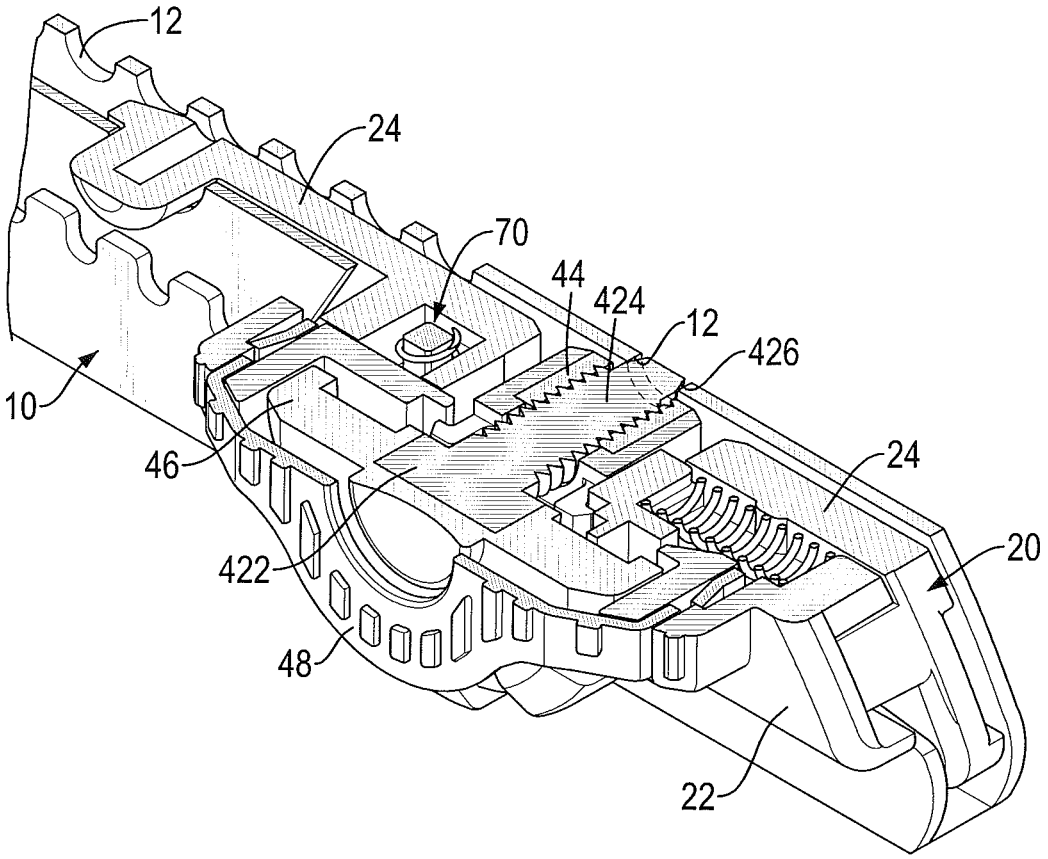
FIG. 6 is an enlarged operational cross sectional perspective view of the cutter assembly in FIG. 1.

With reference to FIGS. 5 and 6, when a user pushes the slider 20 to move relative to the blade holder 10, the engaging segments 12 on the bottom 15 of the blade holder 10 are covered by the blade 50. As the positioning segments 112 can provide a guiding effect to the slider 20 sliding thereon, the user can easily move the slider 20 and the locking bolt 42 to a desired and predetermined travel distance without having to align the locking bolt 42 with the engaging segments 12. The blade 50 is moved with the slider 20 to extend out from the blade holder 10 to a desired extension length. Then, the locking bolt 42 is rotated to make the engaging end of the threaded rod 424 rotate relative to the locking sleeve 44 and engage with a corresponding one of the engaging segments 12. With the engagement between the engaging segment 12 and the threaded rod 424, a firm locking force is provided to the slider 20 and the blade 50. Accordingly, the blade 50 will not be moved unintentionally when the user is cutting a thick object or when a large force is applied to the blade 50. In addition, wear between the locking bolt 42 and the blade holder 10 can be prevented, such that a sufficient locking force can be provided to the blade 50 and such that the service life of the cutter assembly can be prolonged.

Figure 7:
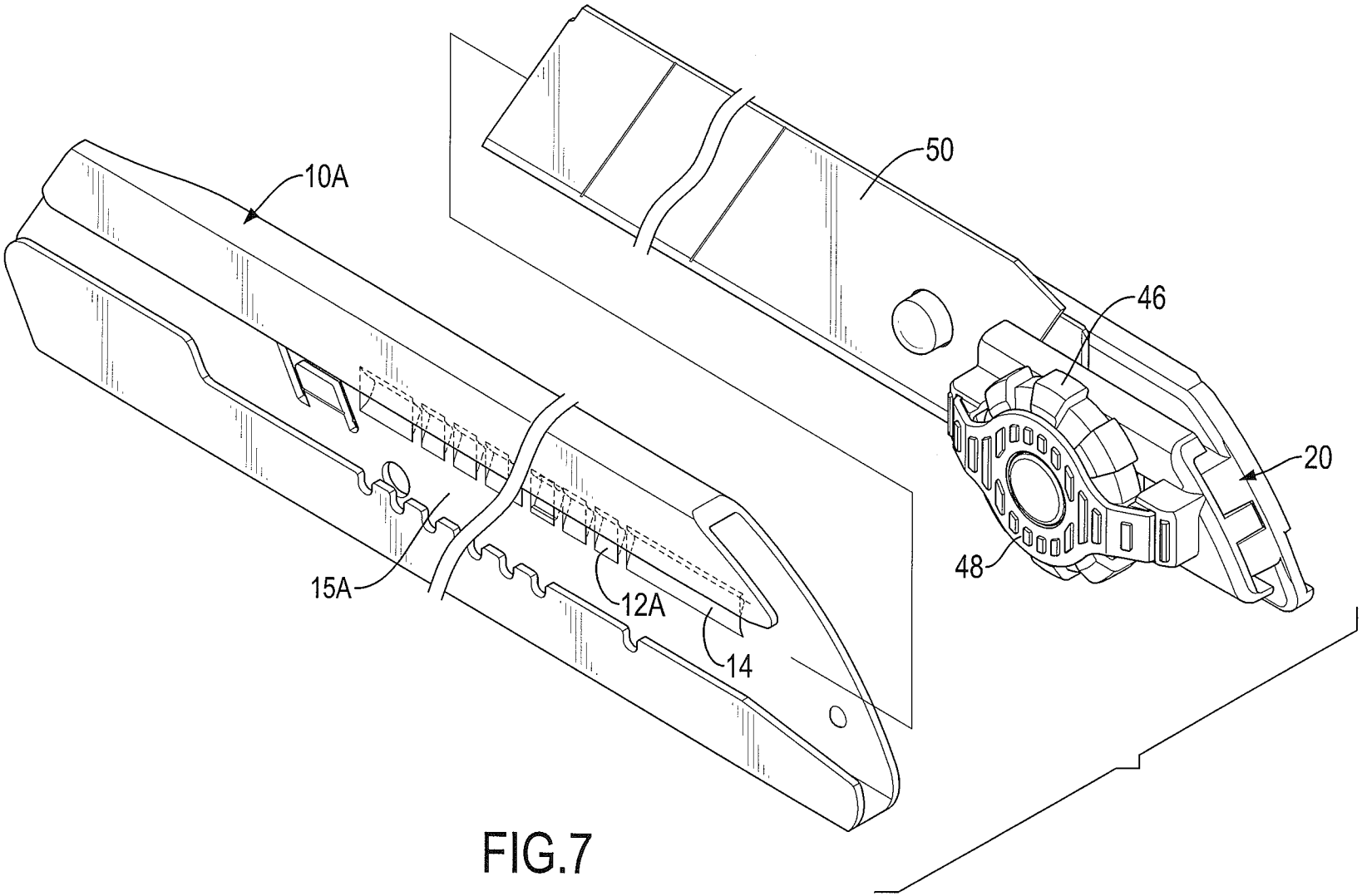
FIG. 7 is an exploded perspective view of a second embodiment of a cutter assembly in accordance with the present invention.
Figure 8:
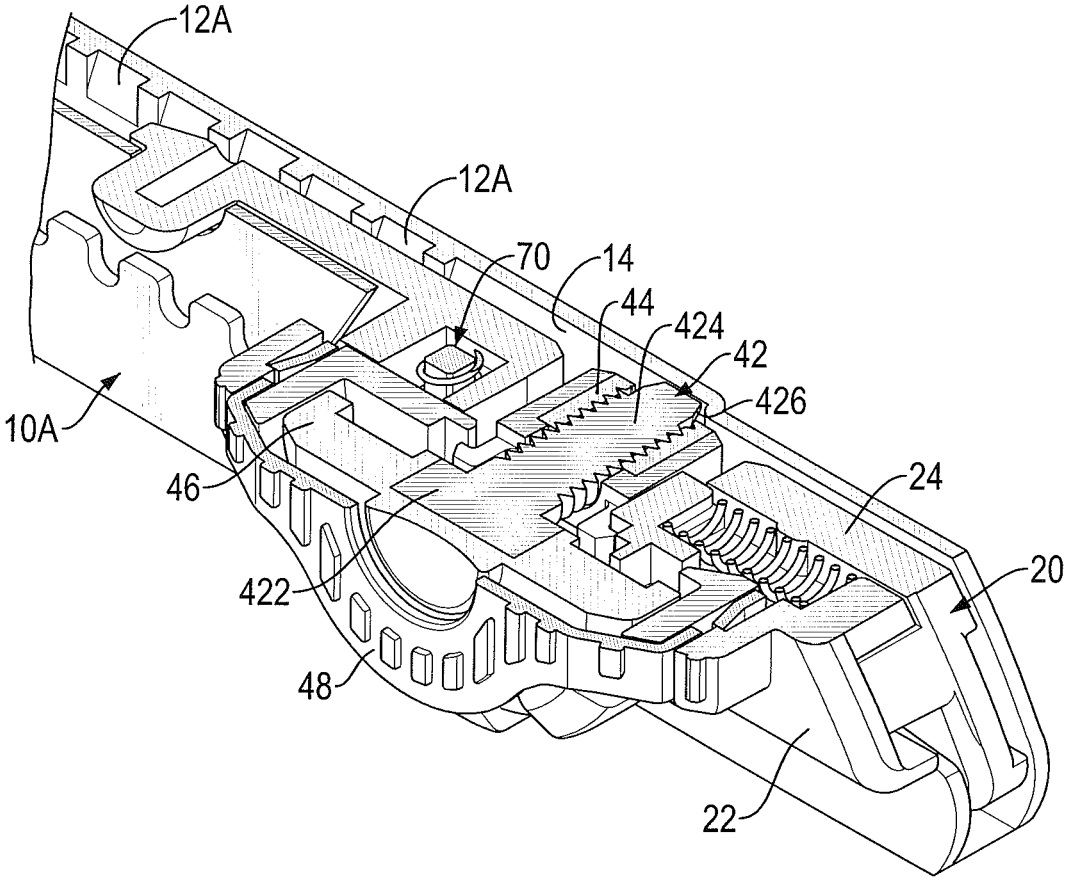
FIG. 8 is an enlarged cross sectional perspective view of the cutter assembly in FIG. 7.
Figure 9:
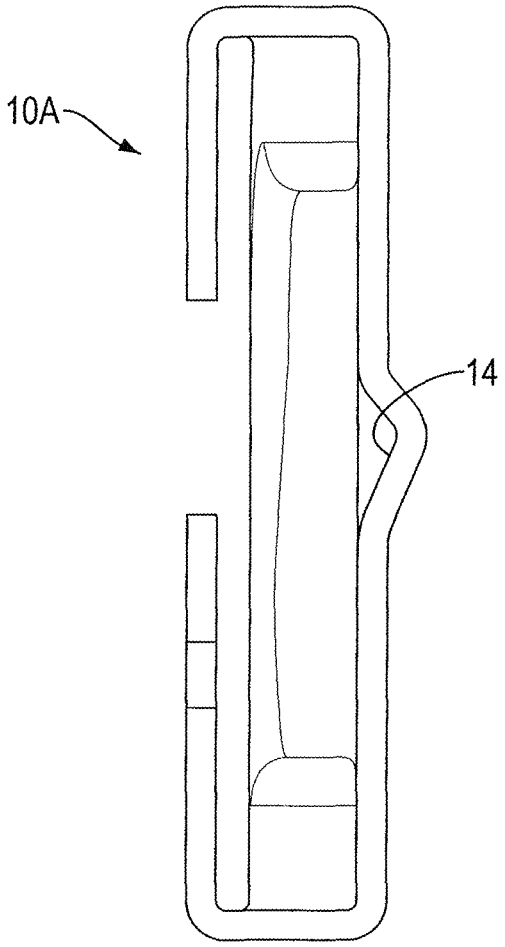
FIG. 9 is an enlarged side view in partial section of the cutter assembly in FIG. 7.

With reference to FIGS. 7 to 9, a second embodiment of a cutter assembly in accordance with the present invention, the structure of the second embodiment is similar to that of the first embodiment except that a groove 14 having a triangular or V-shaped cross section is formed in the bottom 15A of the blade holder 10A. The engaging segments 12A are disposed in the groove 14 and are recesses formed un-through the blade holder 10A. Accordingly, the engaging segments 12A of a recess-type can engage the threaded rod 424 of the locking bolt 42 to provide an excellent positioning effect to the blade 50.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cutter assembly comprising:

a blade holder in which a blade is moveably mounted and has a moving direction, with the blade holder having a bottom and multiple engaging segments disposed on the bottom along the moving direction of the blade, wherein the blade holder has a guiding channel defined in a side of the blade holder and having multiple positioning segments formed in at least one side edge of the guiding channel, wherein the positioning segments correspond respectively to the engaging segments in position, wherein the multiple positioning segments are teeth;

a slider mounted slidably on the blade holder and connected to the blade, wherein the slider comprises an upper sliding member and a lower sliding member combined with each other; and a screw-locking device mounted on the slider and comprising a locking bolt and a locking sleeve screwed with each other, with the locking bolt having an end selectively engaging at least one of the multiple engaging segments, wherein the locking bolt is rotatably mounted on the upper sliding member, wherein the slider is moveable relative to the multiple positioning segments to allow the screw-locking device to move with the slider and to be positioned, wherein the locking bolt comprises:

a threaded rod having an end;

a head formed on the end of the threaded rod; and a rotating knob mounted around the head; and wherein the locking sleeve is mounted in the lower sliding member.

2. The cutter assembly as claimed in claim 1 further comprising an automatic locking device mounted on the slider and resiliently and selectively engaging at least one of the multiple positioning segments.

3. The cutter assembly as claimed in claim 2 further comprising a protective cap mounted on the upper sliding member and covering the rotating knob.

4. The cutter assembly as claimed in claim 2, wherein the multiple engaging segments are arranged in a line along the moving direction of the blade.

5. The cutter assembly as claimed in claim 4, wherein each engaging segment has a shape selected from one of round and square.

6. The cutter assembly as claimed in claim 4, wherein each engaging segment is a through hole formed through the blade holder.

7. The cutter assembly as claimed in claim 6, wherein the bottom of the blade holder has a flat inner surface.

8. The cutter assembly as claimed in claim 4, wherein the end of the locking bolt multiple engaging at least one of the engaging segments is defined as an engaging end and has a guiding structure protruding from the engaging end of the locking bolt to make the engaging end non-flat.

9. The cutter assembly as claimed in claim 4, wherein each engaging segment is a recess formed un-through the blade holder.

10. The cutter assembly as claimed in claim 9, wherein the blade holder further has a groove formed in the bottom of the blade holder; and the multiple engaging segments are disposed in the groove.

11. The cutter assembly as claimed in claim 10, wherein each engaging segment is round in shape.

12. The cutter assembly as claimed in claim 11, wherein the end of the locking bolt engaging at least one of the multiple engaging segments is defined as an engaging end and has a guiding structure protruding from the engaging end of the locking bolt to make the engaging end non-flat.

13. The cutter assembly as claimed in claim 10, wherein each engaging segment is square in shape.

14. The cutter assembly as claimed in claim 13, wherein the end of the locking bolt engaging at least one of the multiple engaging segments is defined as an engaging end and has a guiding structure protruding from the engaging end of the locking bolt to make the engaging end non-flat.

15. The cutter assembly as claimed in claim 4, wherein the multiple engaging segments are ribs arranged at intervals.

16. The cutter assembly as claimed in claim 15, wherein the end of the locking bolt engaging at least one of the multiple engaging segments is defined as an engaging end and has a guiding structure protruding from the engaging end of the locking bolt to make the engaging end non-flat.

17. The cutter assembly as claimed in claim PEI 1, wherein the multiple engaging segments are arranged in a line along the moving direction of the blade.

18. The cutter assembly as claimed in claim 17, wherein the end of the locking bolt engaging at least one of the multiple engaging segments is defined as an engaging end and has a guiding structure protruding from the engaging end of the locking bolt to make the engaging end non-flat.

* * * * *